US006279909B1

(12) United States Patent
Alexander, II et al.

(10) Patent No.: US 6,279,909 B1
(45) **Date of Patent: *Aug. 28, 2001**

(54) GAME HAVING MULTIPLE GAME ACTIVITIES

(75) Inventors: William Whitney Alexander, II; Richard J. Tait, both of Seattle, WA (US)

(73) Assignee: Cranium, Inc., Seattle, WA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/135,383

(22) Filed: Aug. 17, 1998

(51) Int. Cl.[7] ..... A63F 1/00

(52) U.S. Cl. ..... 273/249; 273/302; 273/431; 273/292

(58) Field of Search ..... 273/249, 258, 273/429, 243, 430, 292, 302, 431, 300

(56) References Cited

U.S. PATENT DOCUMENTS

| | | | |
|---|---|---|---|
| 1,327,019 | | 1/1920 | Britton . |
| 1,569,945 | | 1/1926 | Brittingham . |
| 4,216,594 | | 8/1980 | Farley et al. . |
| 4,273,337 | * | 6/1981 | Carrera . |

(List continued on next page.)

FOREIGN PATENT DOCUMENTS

| | | | |
|---|---|---|---|
| 2130741 | | 2/1996 | (CA) . |
| 2 544 624 | | 10/1984 | (FR) . |
| 2680979A1 | * | 3/1993 | (FR) . |
| 2 229 930 A | | 10/1990 | (GB) . |
| 2 241 652 A | | 9/1991 | (GB) . |

OTHER PUBLICATIONS

Game: *Activity Original!*, manufactured by Ferd. Piatnik & Söehne, Vienna, ©1990, English translation of instructions enclosed (4 pages).

Game: *Das Nilpferd in der Achterbahn* (The Hippopotamus in the Roller Coaster), manufactured by Ravensburger Spieleverlag GmbH, Germany, ©1998, English translation of instructions enclosed (4 pages).

(List continued on next page.)

*Primary Examiner*—Benjamin H. Layno
*Assistant Examiner*—V Mendiratta
(74) *Attorney, Agent, or Firm*—Christensen O'Connor Johnson Kindness PLLC

(57) ABSTRACT

A game kit (20) includes a game playing surface (22) marked with a plurality of indicia (42), (44), (46), (48), and (50). The game kit also includes a plurality of markers (26*a*–26*d*) for positioning on indicia of the playing surface. A first deck of cards (24*a*) including a plurality of cards (56) is also included. Each card bearing instructions (64) for a player to carry out an activity. The activity instructions of the cards in the first deck each being associated with a first core or cluster of human competencies selected from the group of factual knowledge competencies, audio/video performance competencies, two and/or three-dimensional graphic competencies, and spelling/vocabulary competencies. The plurality of cards contained in the first deck including at least a first subset of cards directed to a first activity type associated with the first core or cluster of competency(s) and a second subset of cards directed to a second activity type, distinct from the first activity type, associated with the first core or cluster of competency(s). The game also includes a second deck of cards having a plurality of cards bearing instructions for a player to carry out an activity. The second deck of cards contains cards directed to activities associated with a second core or cluster of human competency(s) different at least in part from the first core or cluster of competencies associated with the first deck. Performance of the activities on the cards of the first and second decks determining advancement of a player's marker on the game playing surface.

30 Claims, 15 Drawing Sheets

U.S. PATENT DOCUMENTS

| | | | |
|---|---|---|---|
| 4,291,884 | * | 9/1981 | Bass . |
| 4,640,513 | | 2/1987 | Montijo . |
| 4,682,956 | * | 7/1987 | Kraane . |
| 4,927,147 | | 5/1990 | Delzio . |
| 4,932,667 | | 6/1990 | Gorski et al. . |
| 4,966,371 | | 10/1990 | Sherman . |
| 4,991,854 | | 2/1991 | Weiss . |
| 5,120,066 | * | 6/1992 | Cohen . |
| 5,584,484 | | 12/1996 | Kenvyn . |
| 5,607,160 | * | 3/1997 | Stevens . |
| 5,897,115 | | 4/1999 | Sherry et al. . |
| 5,906,371 | * | 5/1999 | Peterson . |

OTHER PUBLICATIONS

Gane: *Party Time*, manufactured by Ravensburger Spieleverlag GmbH, Germany, ©1998, English translation of instructions enclosed (4 pages).

* cited by examiner

GAME HAVING MULTIPLE GAME ACTIVITIES

FIELD OF THE INVENTION

The present invention relates generally to a game and, more particularly, to a game having multiple activities.

BACKGROUND OF THE INVENTION

Successful board games in the past have focused on a single game activity. A game activity defines actions that a player or players must complete, usually to advance. More specifically, a game activity defines the interaction between the players, game content, and other game components. In some games, the single game activity of responding to questions defines the game. In other games, the game activity focuses on the ability to communicate in nonspoken formats, such as acting out a particular role or drawing an object on a piece of paper. Although such game activities may include multiple topics, the fundamental characteristic of each game focuses only on a single game activity, such as answering questions, drawing, or acting, to determine a player's progression through the game.

While games involving only a single activity enjoy a degree of popularity, they are not without their problems. In particular, one significant problem of such games is the fact that the game is directed only to a single activity. Although such games are enjoyed by those who are skilled in the particular activity of the game, they are not fulfilling to those who lack interest or skill in the particular game activity. Thus, such games fail to appeal to a broader spectrum of players because they focus only on one game activity directed to a single skill.

Research has shown that human activities may be broken into eight general categories referred to herein as intelligences or human core competencies. One of the leading theorists in this area is Dr. Howard Gardner, a professor of education at Harvard University and author of a 1983 book entitled, *Frames of the Mind. The Theory of Multiple Intelligences*, the contents of which are hereby incorporated by reference. According to Dr. Gardner, human skills may be broken down into eight core competencies.

The first core competency is entitled "language." In the language core competency, an individual will think in term of words. These individuals tend to excel at descriptions that are written or verbalized. The second human core competency is entitled "spatial." Individuals in this core competency conceptualize in spatial terms and excel at visualizing situations or thoughts. The third core competency is entitled "logical-mathematical." These individuals excel in the ability to apply logic to systems and numbers. The fourth core competency is entitled "musical." Individuals within this core competency excel at analyzing in musical ways and have an ability to understand and use music. The next core competency is entitled "physical." Individual's having a strong physical core competency learn best by doing the subject and they prefer hands-on contact with the subject. The sixth core competency is entitled "interpersonal." Individuals having a strong interpersonal core competency excel at the ability to relate well with others. The next core competency is entitled "intrapersonal." Individuals having a strong intrapersonal core competency tend to be introspective, thoughtful and reflective. The final core competency is entitled "natural." Individuals who have a strong natural core competency, tend to observe, understand, and organize patterns in the natural environment and enjoy collecting data and objects from the natural world. Thus, according to Dr. Gardner, there are eight general human core competencies to describe human activities.

Viewing games that involve only a single activity in light of the eight core competencies reveals that such games typically address one or two of the eight competencies. In this regard, games that involve the activity of responding to questions appeals to those who have a strong language competency, while those games that require the participants to utilize artistic skills will likely appeal to those who are strong in the spatial core competency classification. Such games do not appeal to those individuals whose capabilities are not within the core competency of the game activity and, therefore, these individuals tend to become disinterested in the game.

Thus, there exists a need for a game that is an aggregation of all of the human core competencies, such that it has broad appeal to a wide variety of players. The present invention is directed to fulfilling this need.

SUMMARY OF THE INVENTION

In accordance with the present invention, a game kit is provided. The game kit includes a game playing surface marked with a plurality of indicia, a plurality of markers for positioning on the indicia of the game playing surface, and a plurality of decks of cards. Each deck includes a plurality of cards, wherein each card bears indicia instructing a player to carry out an activity. Performance of the activity determines advancement of a marker on the game playing surface. Each deck contains cards directed to activities associated with one or more related human competencies. The human competencies of each deck differs at least in part from the competency(s) associated with the activities of the cards contained in the other deck(s). Each deck contains at least a first subset of cards directed to a first activity type and a second subset of cards directed to a second activity type distinct from the first activity type.

In accordance with other aspects of this invention, the human competencies are selected from one of factual knowledge competencies, audio/visual performance competencies, two and/or three-dimensional graphic competencies, and spelling/vocabulary/language competencies.

In accordance with yet other aspects of this invention, each deck of the game kit further includes at least a third subset of cards directed to a third activity type distinct from the first and second activity types.

In accordance with still other aspects of this invention, the indicia on the game playing surface designates first and second paths around the playing surface to track a player's progression through the game. The first track defines a faster progression through the game playing surface, while the second track defines a slower progression through the game playing surface.

A game formed in accordance with the present invention has several advantages over games currently available. First, because the game of the present invention incorporates activities from multiple human core competencies, the game is entertaining and stimulating to a wider variety of players. The game of the present invention is also more challenging because it does not specialize in only one of the human core competencies, but rather includes activities from multiple, and preferably all core competencies. Finally, because the game of the present invention includes activities from each of the core competencies, it is appealing and stimulating to a wider variety of players. Thus, the game of the present invention is more entertaining, challenging, and appealing to a broader spectrum of players than those currently available.

BRIEF DESCRIPTION OF THE DRAWINGS

The foregoing aspects and many of the attendant advantages of this invention will become better understood by reference to the following detailed description, when taken in conjunction with the accompanying drawings, wherein.

DETAILED DESCRIPTION OF THE PREFERRED EMBODIMENT

Figure 1:
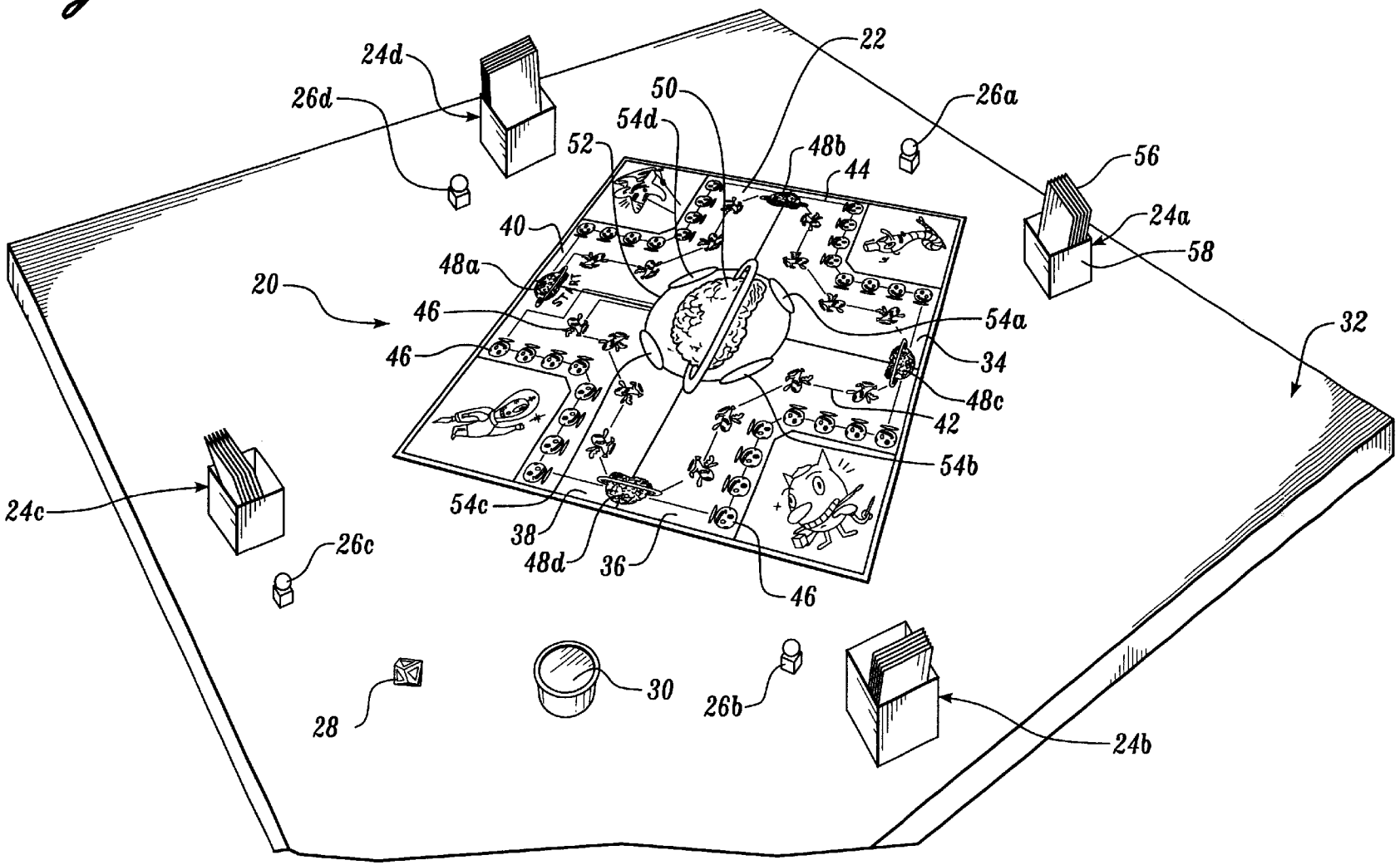
FIG. 1 is an environmental view of a game formed in accordance with the present invention.

FIG. 1 illustrates a preferred embodiment of a game 20 constructed in accordance with the present invention. The game 20 includes a playing surface 22, a plurality of decks of cards 24*a*, 24*b*, 24*c*, and 24*d*, and a plurality of markers 26*a*, 26*b*, 26*c*, and 26*d* for tracking a player's progression through the game. The game 20 preferably also includes a multi-sided die 28 and a tub 30 containing sculpting material, such as putty. The playing surface 22 is illustrated as it would be set up on a table top 32. Although the preferred embodiment illustrated of game 20 is a board game, the game of the present invention may also be configured as a multi-media game and, therefore, other configurations, such as a computer-based playing environment (e.g., a software game for a personal computer or for a computer network) or a television-based playing environment, are also within the scope of the present invention.

The playing surface 22 is made from a rigid material, such as cardboard, and is divided into four zones 34, 36, 38, and 40. The playing surface 22 includes an inner path 42 and an outer path 44. Each path 42 and 44 defines a track around the playing surface 22 that the player or team of players must follow during play of the game. Each path 42 and 44 includes a plurality of cells 46. These cells 46 define stop positions for players as they progress around either the inner or outer paths 42 and 44, as is described in greater detail below. For alternate embodiments of the game, the playing surface may be a wall display (such as for television), a graphical user interface (such as for computers), and may be alternately arranged to track a player's progression or successful completion through activities.

The inner path 42 is spaced inboard from the outer path 44, towards the center of the playing surface 22. The inner path 42 has less cells 46 defined thereon than the outer path 44. As a non-limiting example, and as seen in FIG. 1, the inner path 42 includes half as many cells 46 as the outer path 44. Thus, the inner path 42 defines a shorter track around the playing surface 22. While it is preferred that the inner track 42 has less cells 46 than the outer track 44, other configurations, such as the outer track 44 having less cells than the inner track 42, are also within the scope of the present invention. The number of cells 46 and the orientation of the paths 42 and 44 on the playing surface 22 may vary from that illustrated. The inclusion of at least two paths defining separate tracks around the playing surface is not critical, but is preferred because each path defines a different speed in which the players may progress through the game.

At certain points defined along the playing surface 22, the inner and outer paths 42 and 44 intersect to define junctions 48*a*, 48*b*, 48*c*, and 48*d*. Around the perimeter of the first junction 48*a* are defined indicia indicative of the starting position for the game 20. Each junction 48*a*–48*d* includes indicia, such as an illustration, indicative of a free play area, wherein the player may select a card from any one of the decks of cards 24*a*–24*d* of their choice, as is described in greater detail below.

Each cell 46 on the playing surface 22 has one of four colors. The colors are coordinated with one of the deck of cards 24*a*–24*d*. The multi-sided die 28 is also keyed by color to one of the decks of cards. The die 28 has first and second halves. Each half is contoured to define a pentahedron. Four of the five sides of each pentahedron has one of the four colors corresponding to one of the deck of cards 24*a*–24*d*. The fifth side of the pentahedron includes a wild card color, such as purple. Thus, the multi-sided die 28 has a total of ten sides, wherein eight of the ten sides has colors corresponding to one of the deck of cards 24*a*–24*d* and the remaining two sides each have a wild card color included thereon.

Centrally located on the playing surface 22 is indicia, such as an illustration of a cranium, indicative of the end position 50 of the game. Circumscribing the end position 50 is a ring 52 containing four place holders 54*a*, 54*b*, 54*c*, and 54*d*. Each place holder 54*a*–54*d* includes indicia that corresponds in name to one of the deck of cards 24*a*, 24*b*, 24*c*, and 24*d*. Thus, the playing surface 22 has a start position 48*a* and an end position 50 and the two are connected by opposite ends of the inner and outer paths 42 and 44.

Each deck of cards 24*a*–24*d* contain a plurality of cards 56 within a container, such as a box 58. Each deck of cards 24*a*–24*d* represents a grouping of activities associated with one or more human core competencies. As discussed above, there are eight identified human core competencies. However, the eight may be filtered into four subgroups or clusters of competencies because within each competency, there may be overlapping activities. Thus, each deck of cards 24*a*–24*d* is categorized according to one or more related core competencies, with the core or clustered competencies of each deck differing at least in part and preferably substantially from the other decks.

Although each deck of cards 24*a*–24*d* is directed to one or more related core competencies, the cards 56 within each deck are directed to distinct activities from within that particular core competency. Thus, the decks of cards 24*a*–24*d* included in the game 20 are divided into four groupings of one or more related human core competencies, and the cards within each deck are further subdivided into distinct activities from within a particular grouping. The cards of each deck may be categorized into subsets of two or more distinct activities, and preferably from three to five activities.

The first core competency is a factual knowledge-based competency and includes three separate activities from within that competency. The first is a true/false question and answer activity. The second is a multiple choice question and answer activity. The third activity is a factual question and answer activity, wherein the player answers a particular fact-based question. Thus the first deck includes cards of three types or subsets, each directed to a corresponding activity, which are intermixed within the deck.

The second core competency is an audio/visual performance competency. Within this competency, there are three individual activities. The first activity requires the player to hum or whistle a particular tune while the remaining players attempt to guess the tune. The second activity requires the player to mimic a famous person, while the remaining players attempt to guess the name of the famous person. The third activity from within this core competency requires the player to act out a particular role or object without speaking, while the remaining players attempt to guess the object or person.

The third human core competency is directed to two and/or three-dimensional graphic competency. Within this competency, the activity is directed towards the creative rendering abilities of a player. This competency also includes three activities. The first activity requires a player to draw an object with their eyes closed, while the remaining players attempt to guess the object being drawn. The second activity from within this core competency requires the player to mold or sculpt an object using the putty from the tub 30, while the remaining players attempt to guess the object being molded. The third activity from within this core competency requires a player to draw the object on a piece of paper, while the remaining players attempt to guess the object being drawn.

The final core competency of the present invention is a spelling/vocabulary or language competency and includes five activities. The first activity requires a player or team of players to unscramble and rearrange letters to correctly spell or answer a question. The second activity from within this core competency requires a player spell a given word backwards on a first try. The third activity from within this core competency requires a player to give the correct definition of an uncommon word provided. The fourth activity from within this core competency requires a player from within a team to pick another player from that team to correctly spell challenging words. The fifth and final activity from within this core competency requires a player to correctly spell a word by filling in a blank(s) within a sequence of letters.

Thus, the game 20 of the present invention includes four decks of cards, wherein each deck of cards is directed to a general category or cluster of human core competencies and within each core competency, the competency is subdivided into specific activities from within that particular human core competency.

Figure 2:
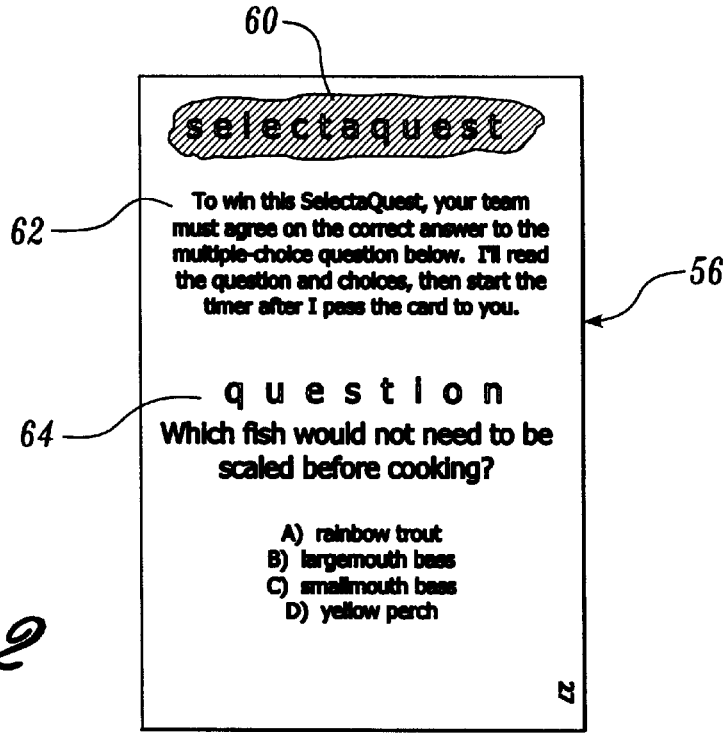
FIG. 2 is a frontal view of a representative card from within one of the decks of a game formed in accordance with the present invention showing indicia providing instructions for a particular activity.
Figure 3:
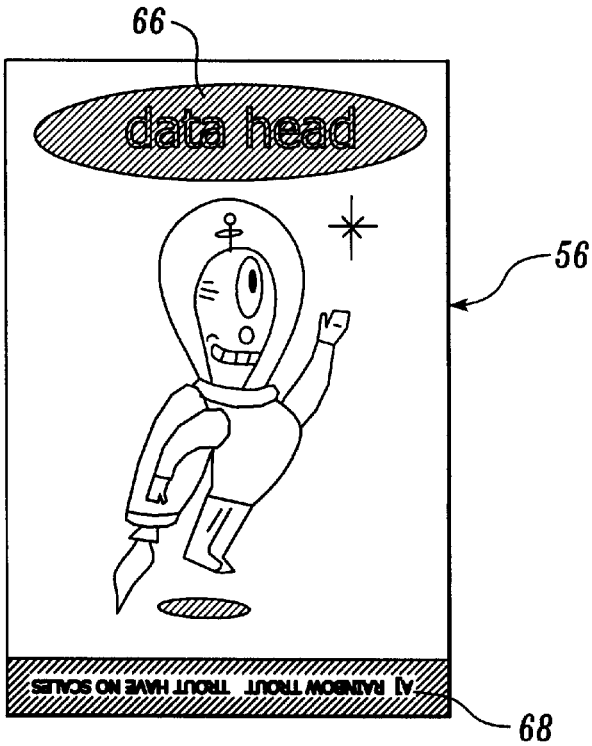
FIG. 3 is a back view of the card shown in FIG. 2 and showing the answer to the particular activity.

Referring to FIGS. 2–3, attention is now directed to the cards 56 from within a deck of cards 24. The cards from within each deck of cards are similarly configured (except that they each bear different indicia and instructions) and, therefore, only one of cards 56 is described in greater detail. Referring to FIG. 2, the front of each card 56 includes a title 60, instructions 62, and an activity section 64. The title 60 defines the name of the activity for the particular card chosen. The instruction 62 provides directions to the players on how to answer or carry out the particular activity of the card chosen. The activity section 64 includes instructions about the specific activity that the individual must perform, answer, create, or otherwise correctly satisfy in order to progress through the game. As may be seen better by referring to FIG. 3, the reverse side of the card 56 includes a title 66 for the human core competency and an answer key 68. The answer key 68 provides the solution or answer to the activity section 64 on the other side of the card 56.

A representative multiple choice question and answer activity is illustrated in FIGS. 2 and 3. A representative instruction from within this activity is: "To win this Selectaquest, your team must agree on the correct answer to the multiple choice question below. I'll read the question and choices, then start the timer after I pass the card to you." The representative question from the activities section 64 is: "Which fish would not need to be scaled before cooking? a) Rainbow Trout; b) Largemouth Bass; c) Smallmouth Bass; and d) Yellow Perch." A representative answer is: "a) Rainbow Trout. Trout have no scales."

Figure 4:
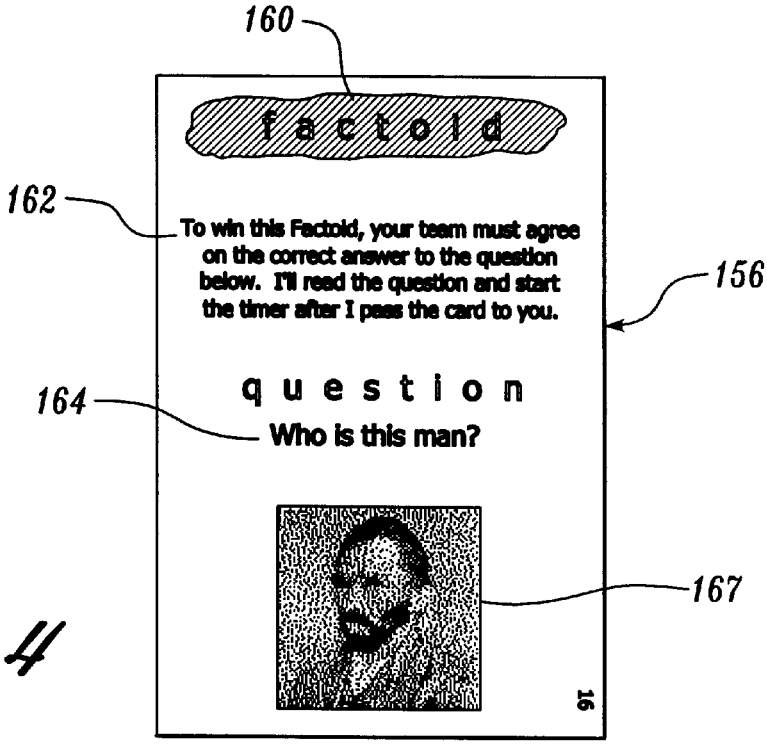
FIG. 4 is a frontal view of a representative card from within one of the decks of a game formed in accordance with the present invention showing indicia providing instructions for a particular activity.
Figure 5:
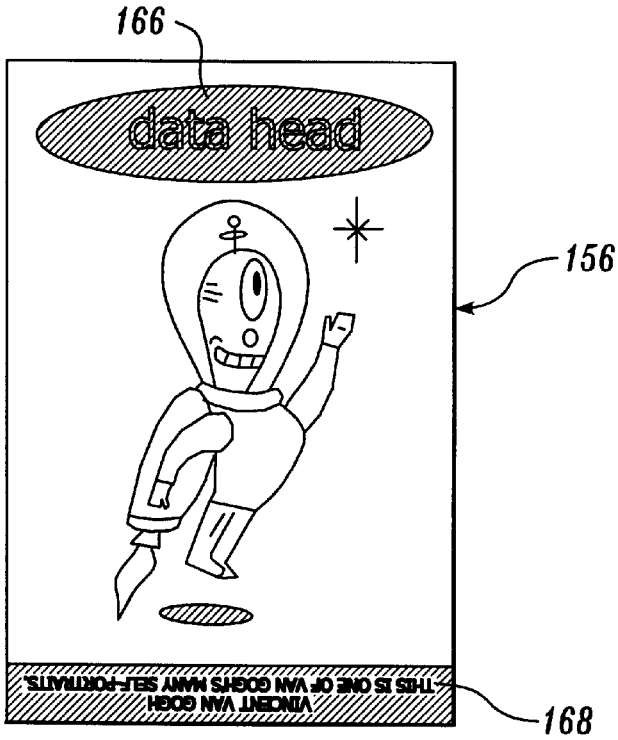
FIG. 5 is a back view of the card shown in FIG. 4 and showing the answer to the particular activity.

A factual questions and answer activity from within the factual knowledge base competency is illustrated in FIGS. 4 and 5. A representative instruction 162 from within this activity is: "To win this factoid, your team must agree on the correct answer to the question below. I will read the question and start the timer after I pass the card to you." A representative question from the activity section 164 for this activity is: "Who is this man?" and is followed by a portrait 167. A representative answer for this activity is set forth in the answer key 68 and is set forth as follows: "Vincent Van Gogh."

Figure 6:
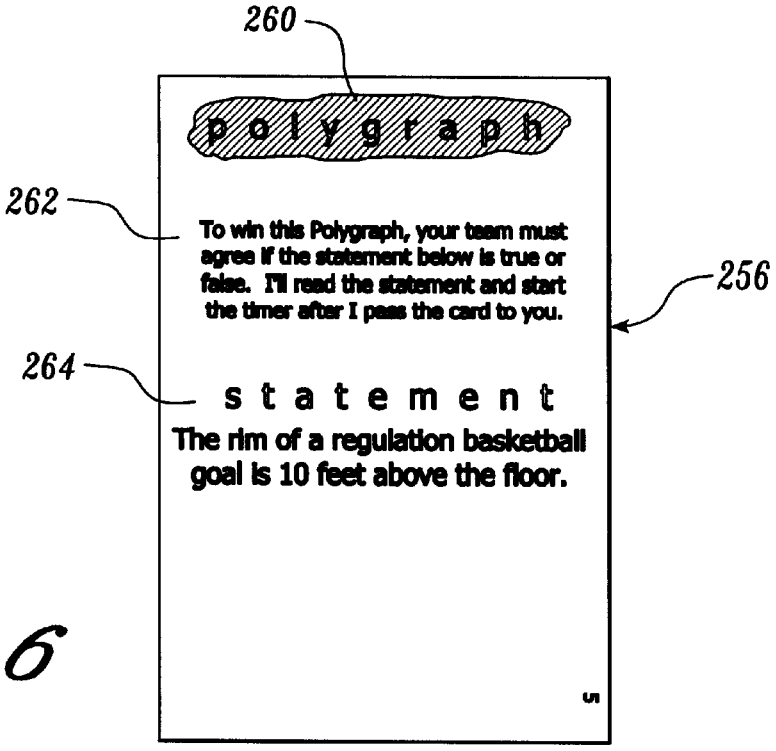
FIG. 6 is a frontal view of a representative card from within one of the decks of a game formed in accordance with the present invention showing indicia providing instructions for a particular activity.
Figure 7:
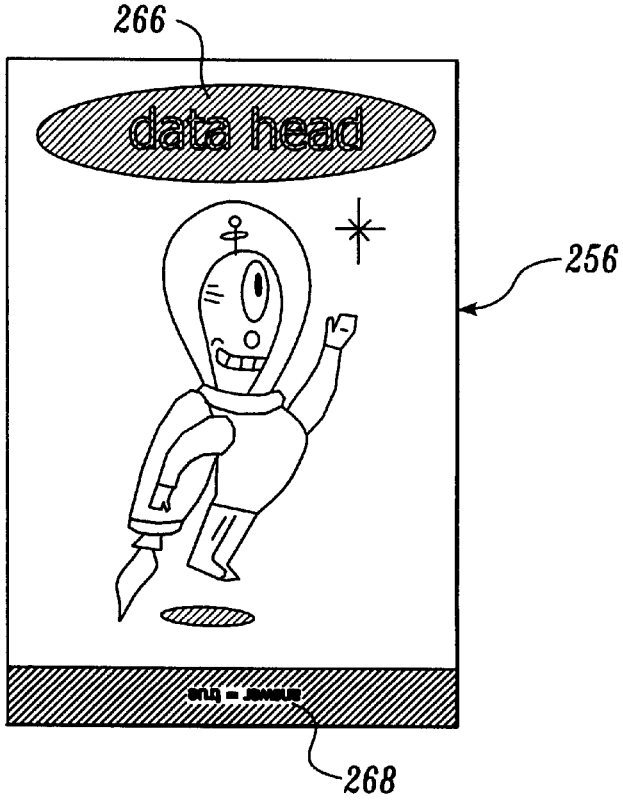
FIG. 7 is a back view of the card shown in FIG. 6 and showing the answer to the particular activity.

A true-false activity from within the factual knowledge base competency is illustrated in FIGS. 6 and 7. A representative instruction 262 from within this activity is: "To win this polygraph, your team must agree if the statement below is true or false. I'll read the statement and start the timer after I pass the card to you." A representative question from the activity section 264 for this activity is: "The rim of a regulation basketball goal is 10 feet above the floor." A representative answer for this activity is set forth in the answer key 268 and is set forth as follows: "Answer=True."

Figure 8:
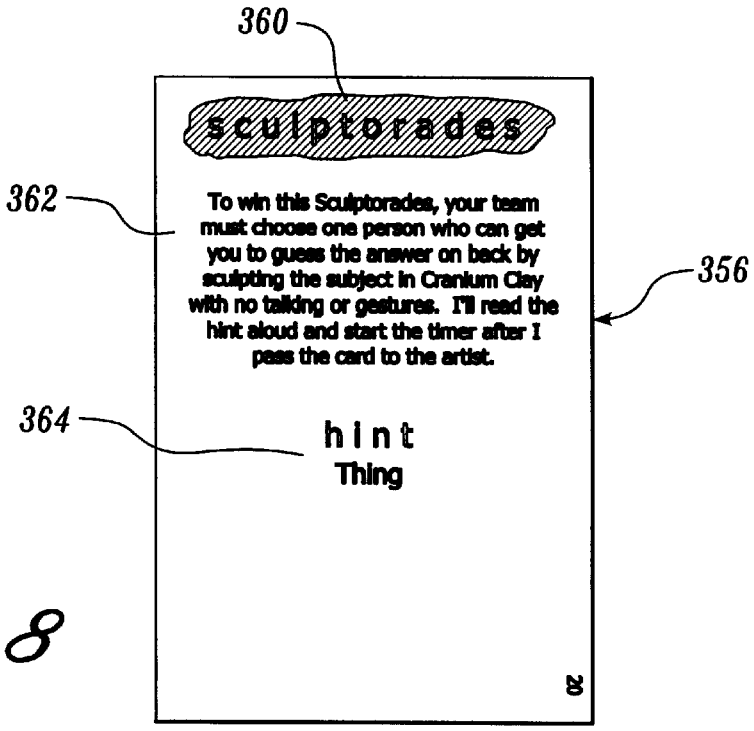
FIG. 8 is a frontal view of a representative card from within one of the decks of a game formed in accordance with the present invention showing indicia providing instructions for a particular activity.
Figure 9:
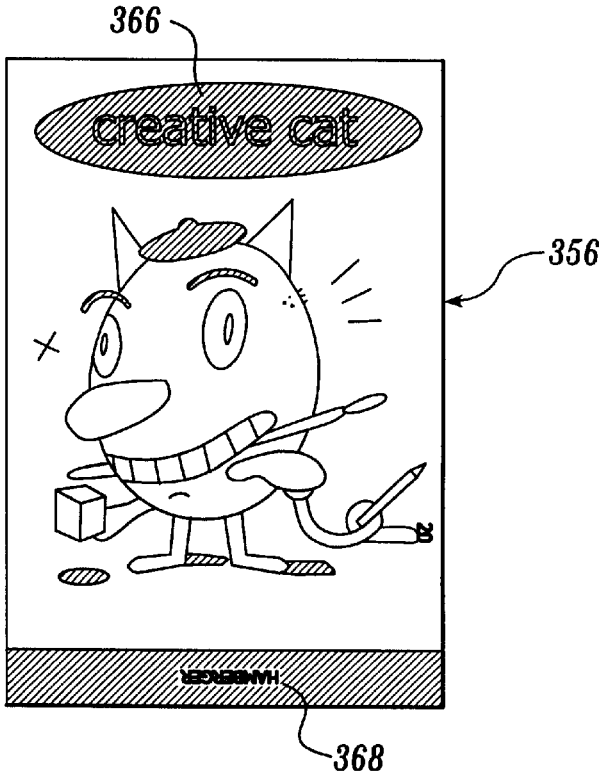
FIG. 9 is a back view of the card shown in FIG. 8 and showing the answer to the particular activity.

A sculpting activity from within the two and/or three-dimensional competency is illustrated in FIGS. 8 and 9. A representative instruction section 362 from within this activity is: "To win the sculptorades your team must choose one person who can get you to guess the answer on back by sculpting the subject in Cranium Clay with no talking or gestures. I'll read the hint aloud and start the timer after I pass the card to the artist." A representative object from the activity section 364 for this activity is: "Thing." A representative answer for this activity is set forth in the answer key 368 and is set forth as follows: "Hamburger."

Figure 10:
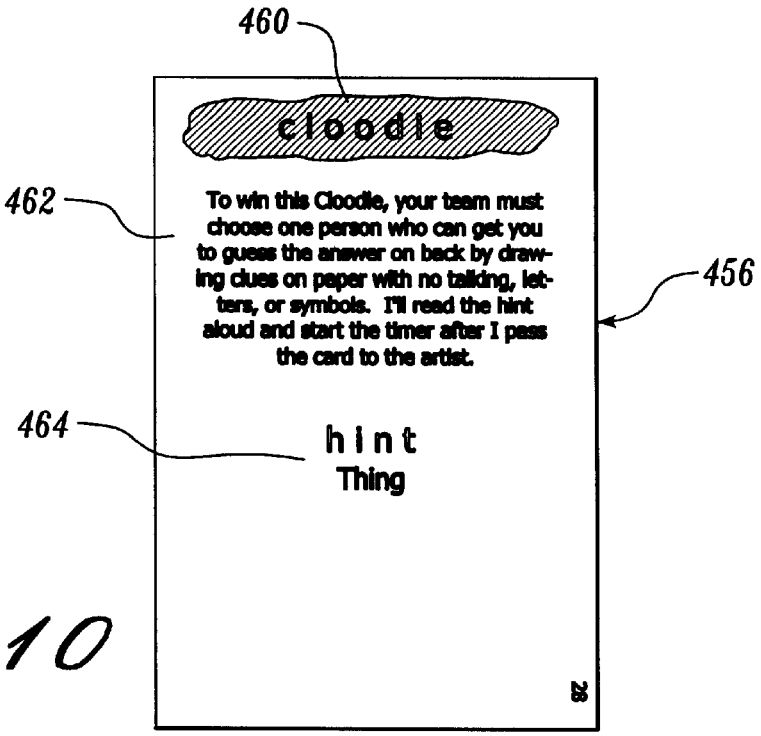
FIG. 10 is a frontal view of a representative card from within one of the decks of a game formed in accordance with the present invention showing indicia providing instructions for a particular activity.
Figure 11:
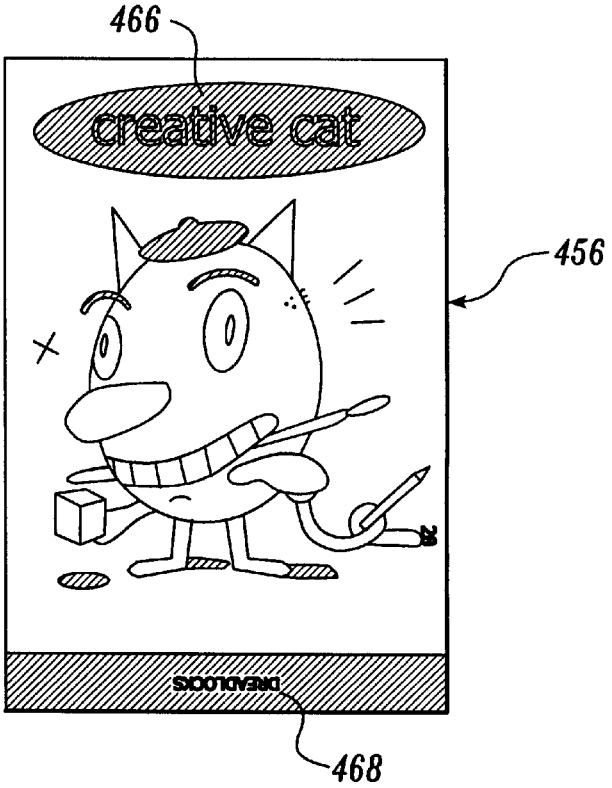
FIG. 11 is a back view of the card shown in FIG. 10 and showing the answer to the particular activity.

A drawing activity from within the two and/or there dimensional graphic competency is illustrated in FIGS. 10 and 11. A representative instruction 462 from within this activity is: "To win this Cloodle, your team must choose one person who get you to guess the answer on back by drawing clues on paper with no talking, letters, or symbols. I'll read the hint aloud and start the timer after I pass the card to the artist." A representative subject as set forth in the activity section 464 for this activity is: "Thing." A representative answer is set forth in the answer key 468 and is set forth as follows: "Dreadlocks."

Figure 12:
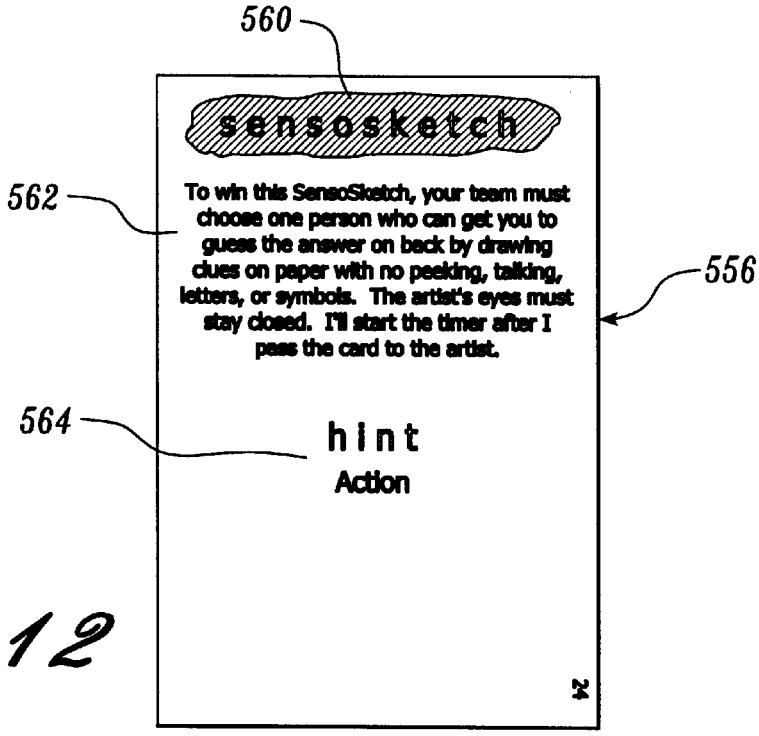
FIG. 12 is a frontal view of a representative card from within one of the decks of a game formed in accordance with the present invention showing indicia providing instructions for a particular activity.
Figure 13:
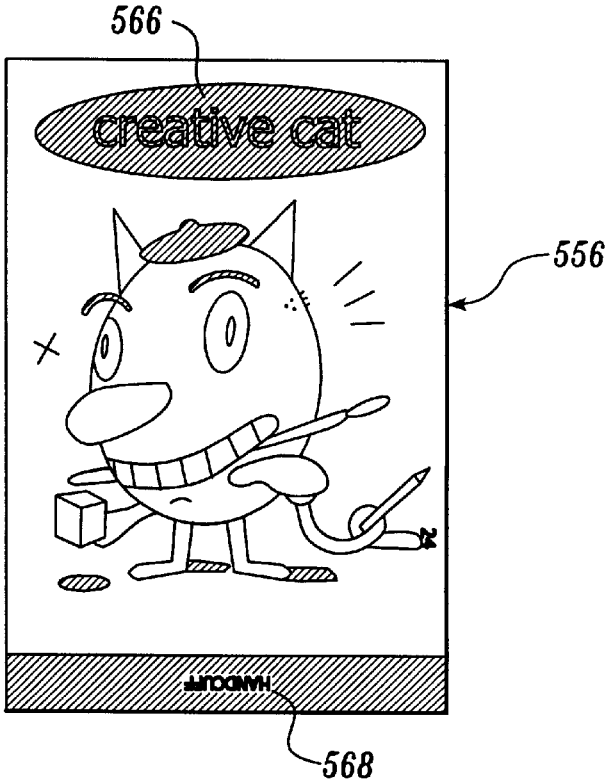
FIG. 13 is a back view of the card shown in FIG. 12 and showing the answer to the particular activity.

A representative instruction 562 for drawing an object with the illustrators eyes closed is illustrated in FIGS. 12 and 13 and is set forth as follows: "To win this Sensosketch, your team must choose one person who can get you to guess the answer on back by drawing clues on paper with no peaking, talking, letters, or symbols. The artist's eyes must stay closed. I'll start the timer after I pass the card to the artist." A representative hint, as set forth in the activity section 564, for this activity is: "Action." A representative answer for this activity is set forth in the answer key 568 and is set forth as follows: "Handcuff."

Figure 14:
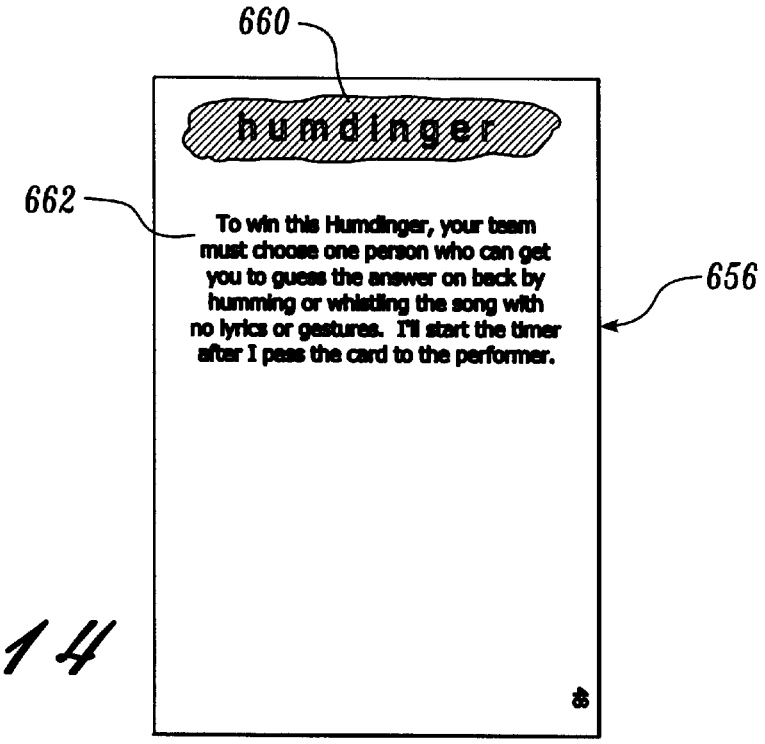
FIG. 14 is a frontal view of a representative card from within one of the decks of a game formed in accordance with the present invention showing indicia providing instructions for a particular activity.
Figure 15:
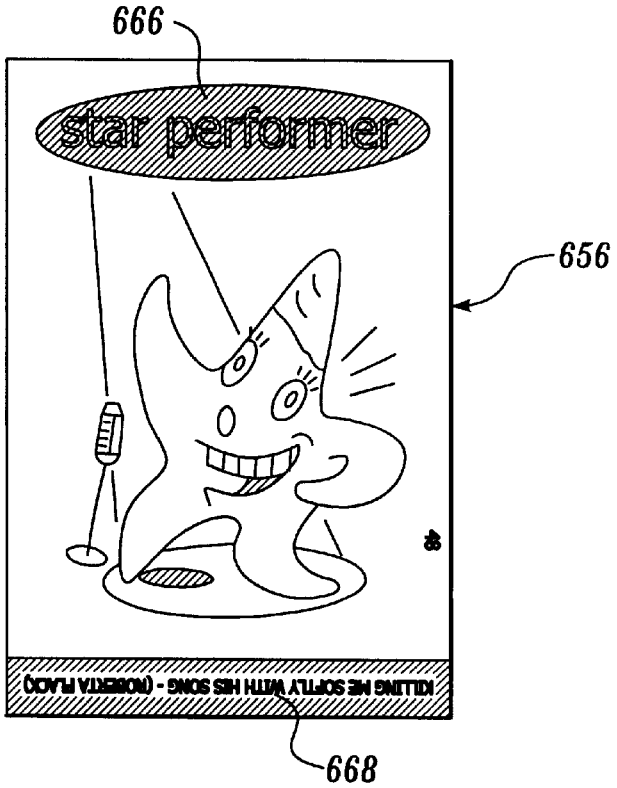
FIG. 15 is a back view of the card shown in FIG. 14 and showing the answer to the particular activity.

A humming or whistling activity from within the audio/visual performance competency is illustrated in FIGS. 14 and 15. A representative instruction 662 from within this activity is: "To win this Humdinger, your team must choose one person who can get you to guess the answer on back by humming or whistling the song with no lyrics or gestures. I'll start the timer after I pass the card to the performer." A representative answer for this activity is set forth in the answer key 668 and is set forth as follows: "Killing Me Softly With His Song—(Roberta Flack)."

Figure 16:
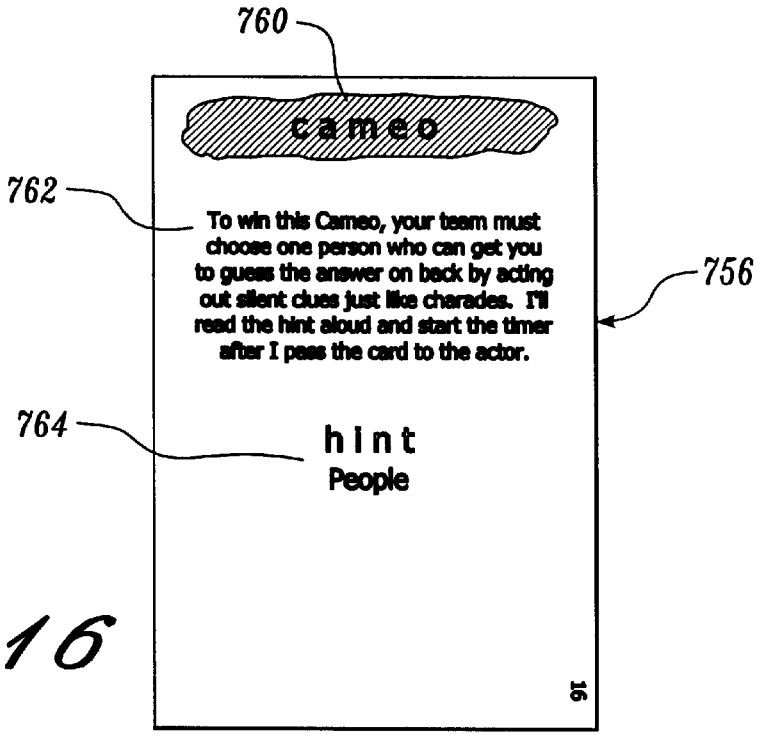
FIG. 16 is a frontal view of a representative card from within one of the decks of a game formed in accordance with the present invention showing indicia providing instructions for a particular activity.
Figure 17:
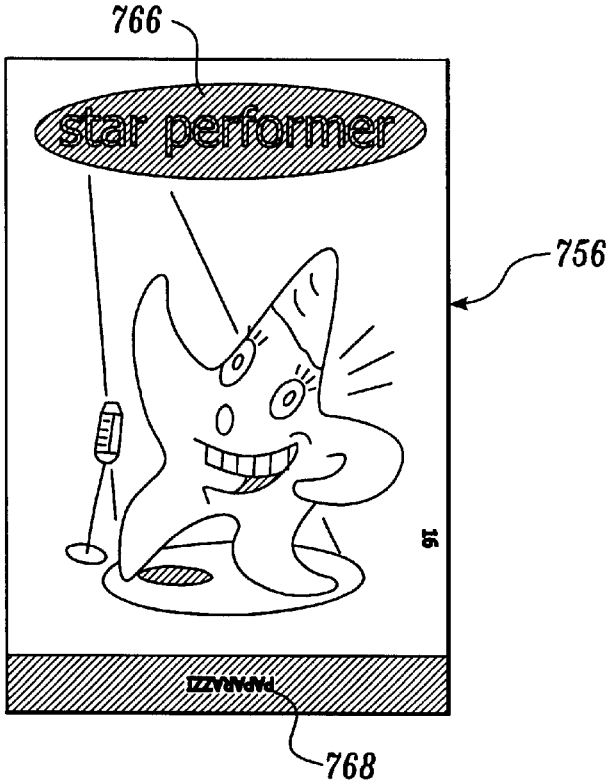
FIG. 17 is a back view of the card shown in FIG. 16 and showing the answer to the particular activity.

A representative activity that requires a player to act out a particular role or object without speaking from within the audio/visual performance competency is set forth in FIGS. 16 and 17. A representative instruction 762 from within this activity is: "To win this Cameo, your team must choose one person who can get you to guess the answer on back by acting out silent clues just like charades. I'll read the hint aloud and start the timer after I pass the card to the actor." A representative hint, as set forth in the activity section 764, for this activity is: "People." A representative answer for this activity is set forth in the answer key 768 and is set forth as follows: "Paparazzi."

Figure 18:
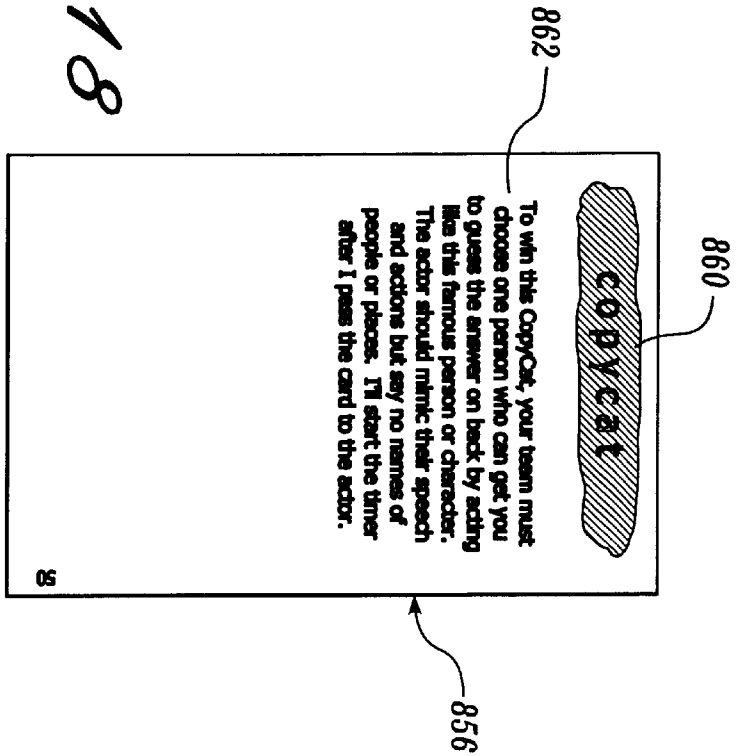
FIG. 18 is a frontal view of a representative card from within one of the decks of a game formed in accordance with the present invention showing indicia providing instructions for a particular activity.
Figure 19:
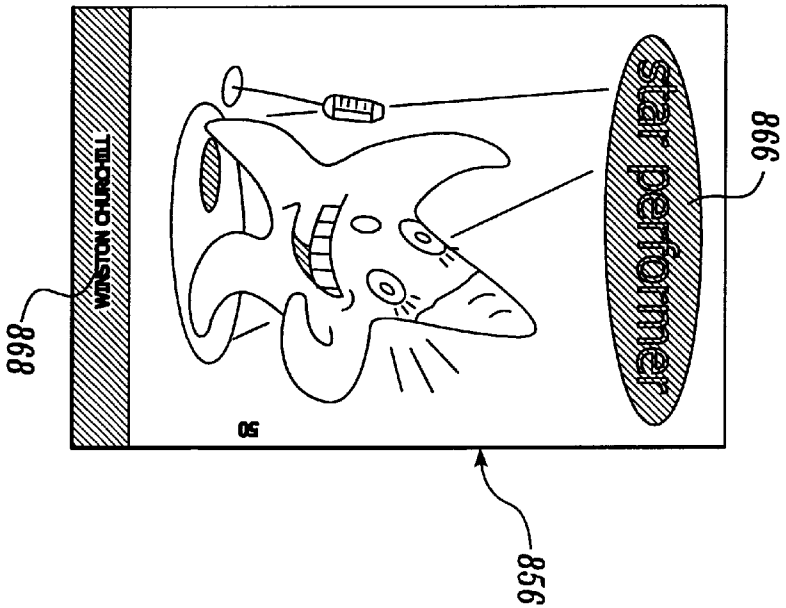
FIG. 19 is a back view of the card shown in FIG. 18 and showing the answer to the particular activity.

An activity that requires a player to mimic a famous person from within the audio/visual performance competency is illustrated in FIGS. 18 and 19. A representative instruction 862 from within this activity is: "To win this Copy Cat, your team must choose one person who can get you to guess the answer on back by acting like this famous person or character. The actor should mimic their speech and actions, but say no names of the people or places. I'll start the timer after I pass the card to the actor." A representative answer for this activity is set forth in the answer key 868 and is set forth as follows: "Winston Churchill."

Figure 20:
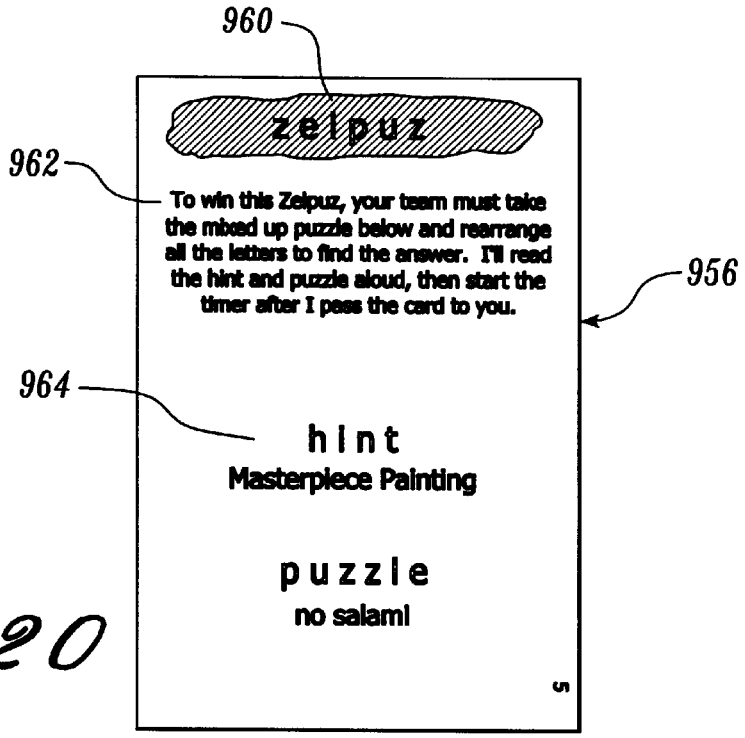
FIG. 20 is a frontal view of a representative card from within one of the decks of a game formed in accordance with the present invention showing indicia providing instructions for a particular activity.
Figure 21:
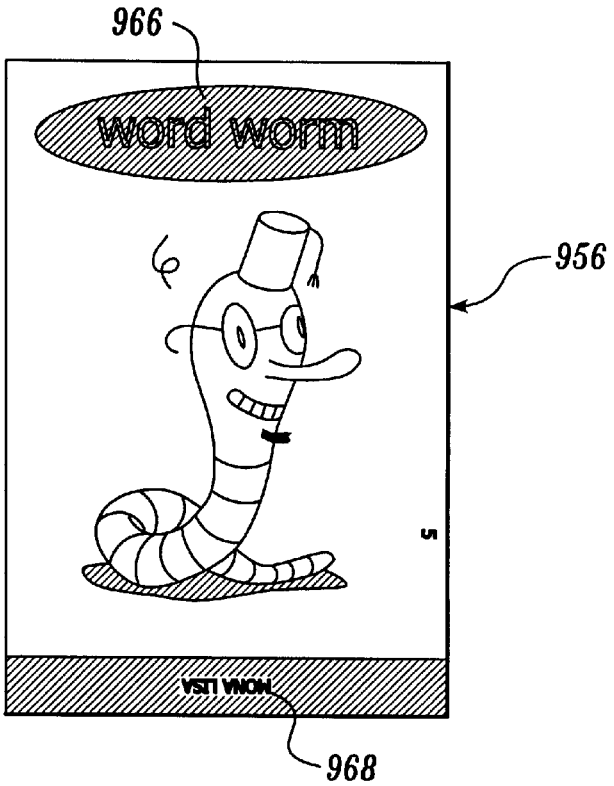
FIG. 21 is a back view of the card shown in FIG. 20 and showing the answer to the particular activity.

An activity from within the spelling/vocabulary/language competency requires a player or team of players to unscramble and rearrange letters to correctly spell or answer a question is illustrated in FIGS. 20 and 21. A representative instruction 962 from within this activity is: "To win this Zelpuz, your team must take the mixed up puzzle below and rearrange all the letters to find the answer. I'll read the hint and puzzle aloud, then start the timer after I pass the card to you." A representative hint and puzzle, as set forth in the activity section 964 for this activity is: "Hint: Masterpiece Painting", "Puzzle: No Salami." A representative answer for this activity is set forth in the answer key 968 and is set forth as follows: "Mona Lisa."

Figure 22:
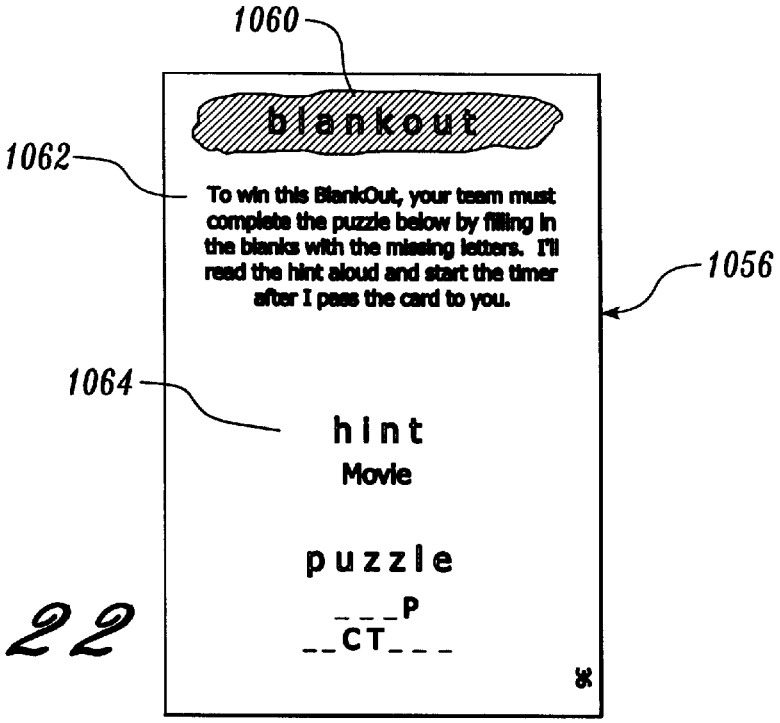
FIG. 22 is a frontal view of a representative card from within one of the decks of a game formed in accordance with the present invention showing indicia providing instructions for a particular activity.
Figure 23:
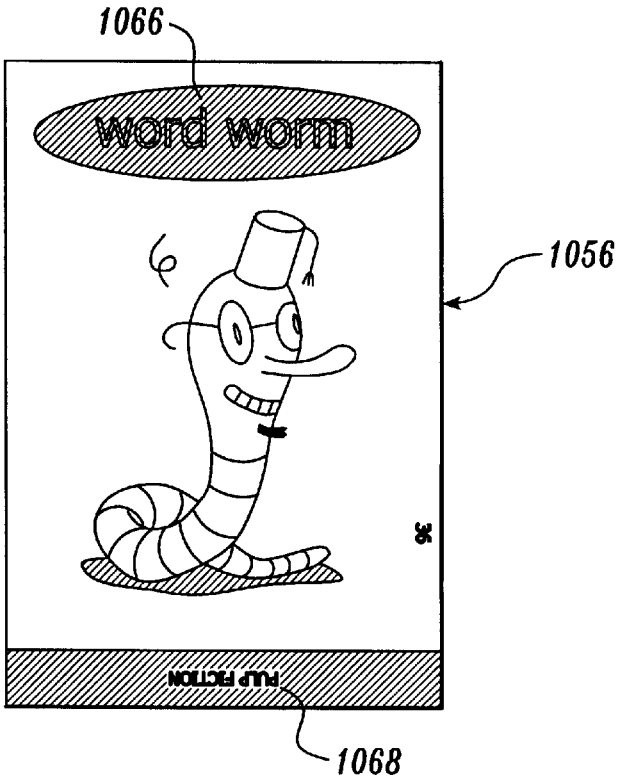
FIG. 23 is a back view of the card shown in FIG. 22 and showing the answer to the particular activity.

Another activity from within the spelling/vocabulary/language competency requires a player to correctly spell a word by filling in a blank(s) within a sequence of letters, and is illustrated in FIGS. 22 and 23. A representative instruction 1062 from within this activity is: "To win this Blank Out, you team must complete the puzzle below by filling in the blanks with the missing letters. I'll read the hint aloud and start the time after I pass the card to you. A representative hint and puzzle, as set forth in the activities section 1064, for this activity is: "Hint: Movie, Puzzle: _____P ___CT _____." A representative answer for this activity is set forth in the answer key 1068 and is set forth as follows: "Pulp Fiction."

Figure 24:
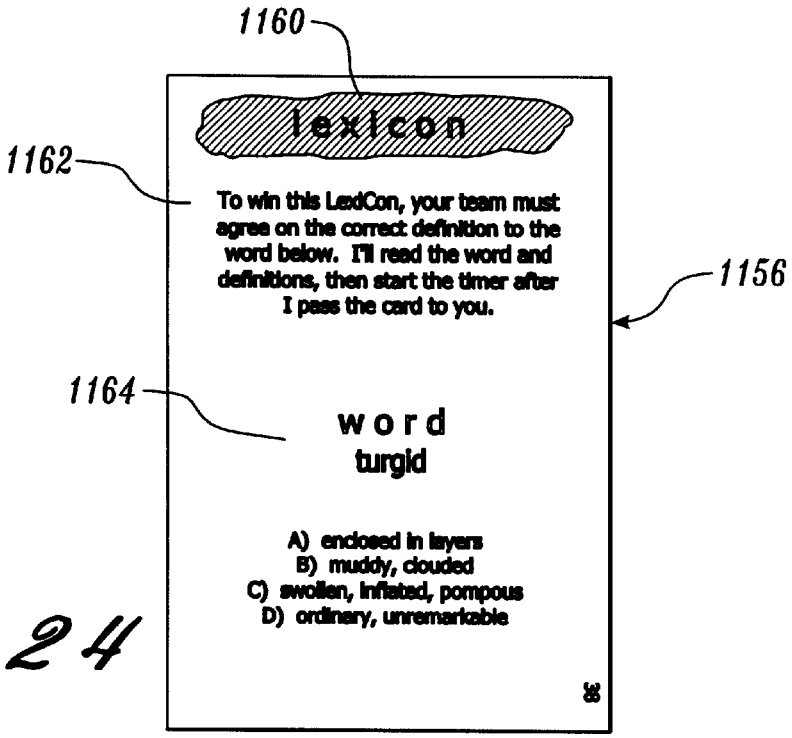
FIG. 24 is a frontal view of a representative card from within one of the decks of a game formed in accordance with the present invention showing indicia providing instructions for a particular activity.
Figure 25:
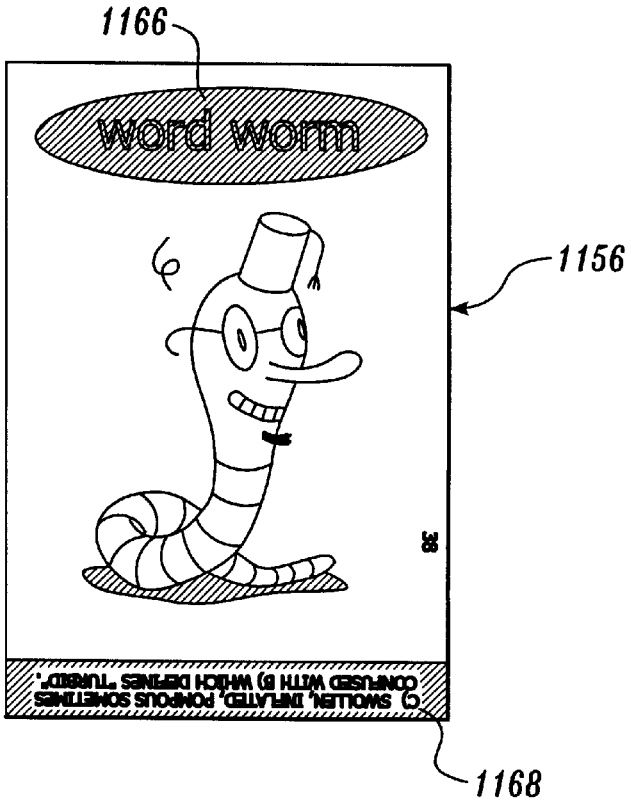
FIG. 25 is a back view of the card shown in FIG. 24 and showing the answer to the particular activity.

Another activity from within the spelling/vocabulary/language competency requires a player to give the correct definition of an uncommon word provided, and is illustrated in FIGS. 24 and 25. A representative instruction 1162 from within this activity is: "To win this Lexicon, your team must agree on the correct definition to the word below. I'll read the word and definitions, then start the timer after I pass the card to you. A representative word, as set forth in the activity section 1164, for this activity is "Turgid a) enclosed in layer; b) muddy, clouded; c) swollen, inflated, pompous; and d) ordinary, unremarkable." A representative answer for this activity is set forth in the answer key 1168 and is set forth as follows: "c) swollen, inflated, pompous. Sometimes confused with b) which defines "Turbid."

Figure 26:
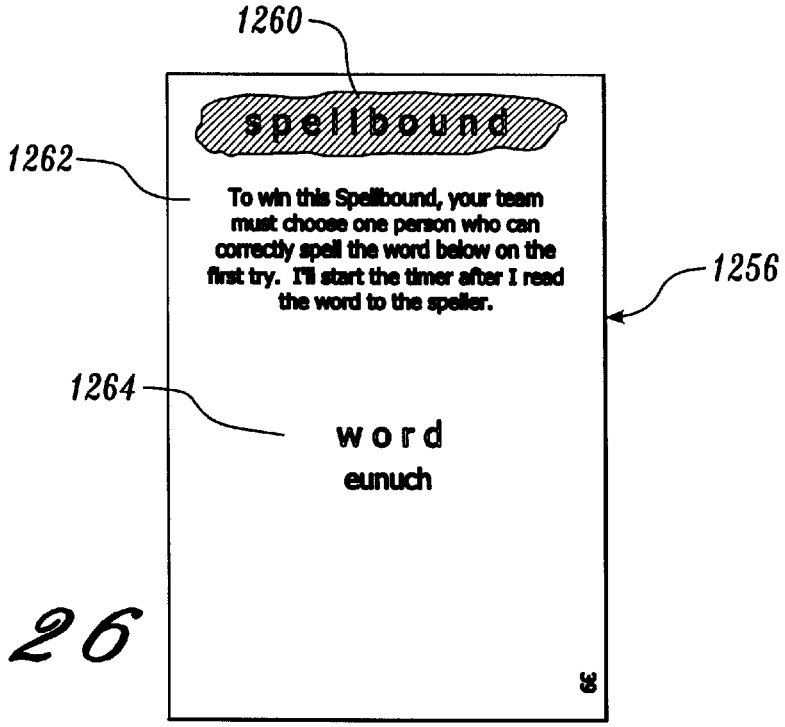
FIG. 26 is a frontal view of a representative card from within one of the decks of a game formed in accordance with the present invention showing indicia providing instructions for a particular activity.
Figure 27:
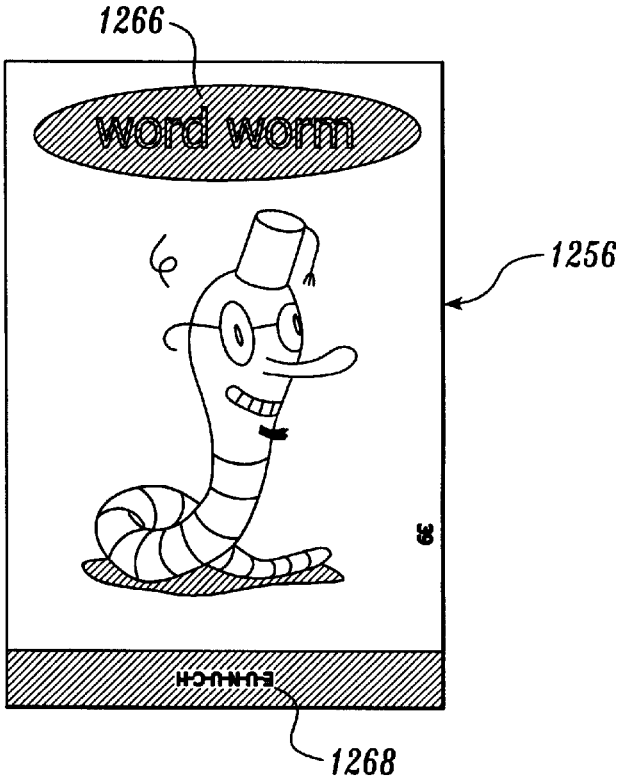
FIG. 27 is a back view of the card shown in FIG. 26 and showing the answer to the particular activity.

Another activity from within the spelling/vocabulary/language competency requires a player from within a team to pick another player from that team to correctly spell challenging words and is illustrated in FIGS. 26 and 27. A representative instruction 1262 from within this activity is: "To win this Spellbound, your team must choose one person who can correctly spell the word below on the first try. I'll start the timer after I read the word to the speller. A representative word, as set forth in the activity section 1264, for this activity is: "eunuch." A representative answer for this activity is set forth in the answer key 1268 and is set forth as follows: "E-U-N-U-C-H."

Figure 28:
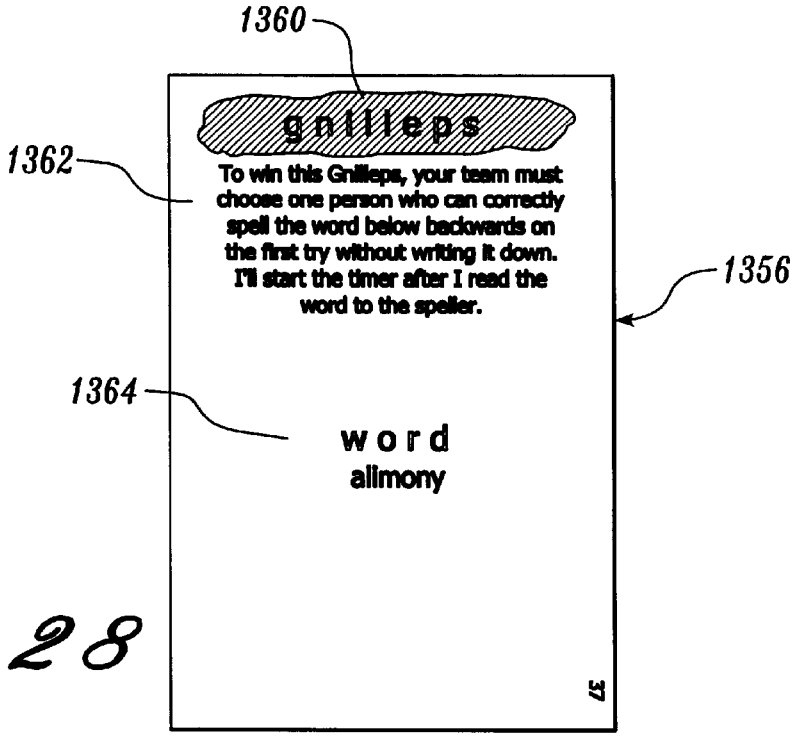
FIG. 28 is a frontal view of a representative card from within one of the decks of a game formed in accordance with the present invention showing indicia providing instructions for a particular activity.
Figure 29:
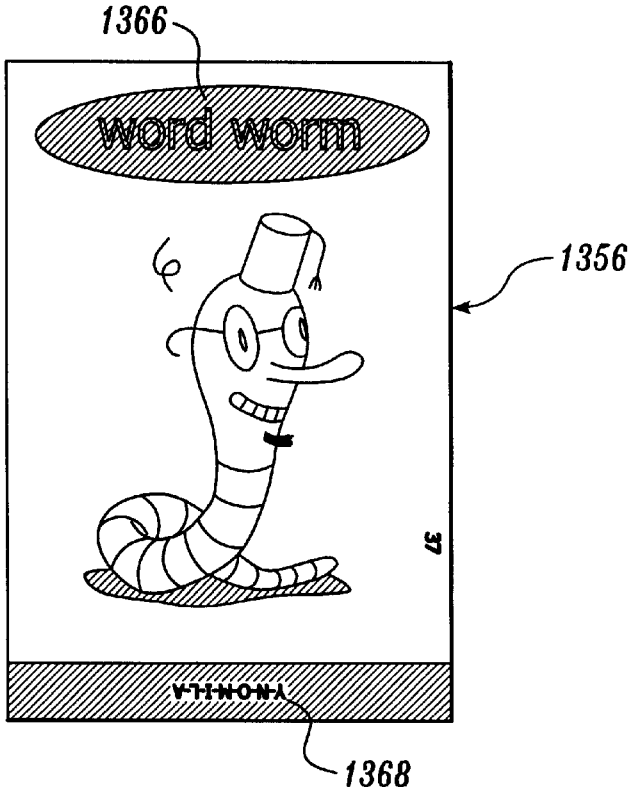
FIG. 29 is a back view of the card shown in FIG. 28 and showing the answer to the particular activity.

Another activity from within the spelling/vocabulary/language competency requires a player to spell a given word backwards on a first try, and is illustrated in FIGS. 28 and 29. A representative instruction 1362 from within this activity is: "To Win this Gnilleps, your team must choose one person can correctly spell the word below backwards on the first try without writing it down. I'll start the timer after I read the word to the speller." A representative question, as set forth in the activity section 1364 for this activity is: "Word: Alimony." A representative answer for this activity is set forth in the answer key 1368 and is set forth as follows: "A-L-I-M-O-N-Y."

The method of game play may be best understood by referring to FIGS. 1—3. To play the game 20 of the present invention, there must be two or more teams. Each team must have two or more players. The game 20 has four decks of cards 24*a*–24*d*. Each deck 24*a*–24*d* contains similar activities and is color coded to match the different positions on the playing surface 22, as indicated by the cells 46 and the faces of the multi-sided die 28. The object of the game is to move around the playing surface 22 to the end position 50 where that particular team will complete its final activities. The journey around the playing surface 22 may be accelerated by getting on the inner track 42 by successfully completing activities on the cells 46.

Play begins on the first junction 48*a* marked "start." From any one of the junctions 48*a*–48*d*, the player may choose any one of the decks 24*a*–24*d*. The team to the right of the starting team draws the next card from the deck the first team chooses and reads the front of the card 56 out loud to the first team. The first team attempts to complete the activity set forth in the activity section 64 of the card 56 before a timer (not shown) expires. If the team is successful, the team may roll the die 28 once. The team advances from the start along the inner path 42 to the first cell 46 that matches the color showing on the die 28. If the player rolls the die 28 and the wild card color, such as purple, shows, then the team goes to the next junction 48*b*. If the team is unsuccessful in completing the activity set forth in the activity section 64, then that team proceeds along the outer path 44. Either way, the first team's play for that particular round is over.

Each team progresses around the playing surface 22 by successfully completing activities and rolling to a new position. Along either the inner or outer paths 42 and 44, the team must stop at every junction 48*a*–48*d*. When on a junction, the team gets to choose from its favorite deck 24 and that team has the chance, depending upon whether they correctly answer the question, to proceed along the faster inner track 42 or the slower outer track 44. When the team is not on a junction, that team must complete an activity from the deck 24 matching the color of the cell 46 on the playing surface 22. When a particular team's play is over for that round, a member from that team reads a card for the next team. To win, the team must enter the ring 52 of the end position 50 on a roll from either the inner path 42 or the outer path 44.

The previously described version of the present invention provides several advantages over games currently available that involve only a single activity. First, because the game of the present invention incorporates activities from each of the human core competencies, the game is more entertaining to a wider variety of players. The game of the present invention is also more challenging because it does not specialize in only one of the human core competencies, but rather includes activities from each competency. Finally, because the game of the present invention includes activities from each of the core competencies, it is more appealing to a wider variety of players. Therefore, a game formed in accordance with the present invention is more entertaining, challenging, and appealing to a broader spectrum of players than those currently available.

From the foregoing description, it may be seen that a game formed in accordance with the present invention incorporates many novel features and offers significant advantages over those currently available. While the presently preferred embodiment of the invention has been illustrated and described, it is to be understood that within the scope of the appended claims, various changes can be made therein without the departing from the scope of the invention.

The embodiments of the invention in which an exclusive property or privilege is claimed are defined as follows:

1. A game kit comprising:

a) a game playing surface marked with a plurality of indicia;

b) a plurality of markers for positioning on indicia of the game playing surface; and c) a plurality of decks of cards, each deck including a plurality of cards, each card bearing indicia instructing a player to carry out an activity, performance of the activity determining advancement of a marker on the game playing surface, wherein:

i) each deck contains cards directed to activities associated with one or more related human competencies, wherein the one or more related human competencies is different at least in part from the competency(s) associated with the activities of the cards contained in the other deck(s); and ii) each deck contains at least a first subset of cards directed to a first activity type and a second subset of cards directed to a second activity type distinct from the first activity type.

2. The game kit of claim 1, wherein the human competencies are selected from the group consisting of factual knowledge competencies, audio/visual performance competencies, two and/or three-dimensional graphic competencies, and spelling/vocabulary/language competencies.

3. The game kit of claim 2, wherein the activities included in the deck of cards directed to the factual knowledge competencies are selected from the group consisting of true/false question and answer activity, multiple choice question and answer activity, and fact based questions.

4. The game kit of claim 2, wherein the activities included in the deck of cards directed to the audio/visual performance competencies are selected from the group consisting of humming or whistling a tune, mimicking a character, and acting.

5. The game kit of claim 2, wherein the activities included in the deck of cards directed to the two and/or three-dimensional graphic competencies are selected from the group consisting of drawing with the player's eyes closed, sculpting, and drawing.

6. The game kit of claim 2, wherein the activities of the cards included in the deck of cards directed to the spelling/vocabulary/language competencies are selected from the group consisting of rearranging letters to correctly spell a word, spelling a word backwards, giving the correct definition of a word, spelling a word, and filling in a blank or blanks to correctly spell a word.

7. The game kit of claim 2, further comprising at least a third subset of cards directed to a third activity type distinct from the first and second activity types.

8. The game kit of claim 1, wherein the indicia on the game playing surface designating first and second paths around the playing surface to track a player's progression through the game, the first track defining a faster progression through the game playing surface, the second track defining a slower progression through the game playing surface.

9. The game kit of claim 8, further comprising a tub of sculpting putty.

10. The game kit of claim 9, wherein the game playing surface comprises a rigid board.

11. The game kit of claim 1, wherein the game playing surface and markers are represented in a multi-media environment.

12. The game kit of claim 11, wherein the multi-media environment comprises a computer based playing environment or an electronic playing environment.

13. A game comprising:

a) a plurality of collections of activity instructions, each collection including a plurality of activity instructions, each activity instruction bearing instructions for a player to carry out an activity, performance of the activity determining the player's success at the game, wherein:

i) each collection of activity instructions contains activity instructions directed to activities associated with one or more related human competencies, wherein the one or more related human competencies is different at least in part from the competency(s) associated with the activity instructions contained in the other collection(s); and ii) each collection of activities contains at least a first subset of activity instructions directed to a first activity type and a second subset of activity instructions directed to a second activity type distinct from the first activity type.

14. The game of claim 13, wherein the human competencies is selected from the group consisting of factual knowledge competencies, audio/visual performance competencies, two and/or three-dimensional graphic competencies, and spelling/vocabulary/language competencies.

15. The game of claim 14, further comprising a plurality of decks of cards, the cards containing the collections of activity instructions, wherein each card containing the activity instructions.

16. The game of claim 15, wherein the activities included in the deck of cards directed to the factual knowledge competencies are selected from the group consisting of true/false question and answer activity, multiple choice question and answer activity, and fact based questions.

17. The game of claim 15, wherein the activities included in the deck of cards directed to the audio/visual performance competencies are selected from the group consisting of humming or whistling a tune, mimicking a character, and acting.

18. The game of claim 15, wherein the activities in the deck of cards directed to the two and/or three-dimensional graphic competencies are selected from the group consisting of drawing with the player's eyes closed, sculpting, and drawing.

19. The game of claim 15, wherein the activities included in the deck of cards directed to the spelling/vocabulary/language competencies are selected from the group consisting of rearranging letters to correctly spell a word, spelling a word backwards, giving the correct definition of a word, spelling a word, and filling in a blank or blanks to correctly spell a word.

20. The game of claim 15, further comprising at least a third subset of activity instructions directed to a third activity type distinct from the first and second activity types.

21. The game of claim 13, further comprising a game playing surface and a plurality of markers, the game playing surface being marked with a plurality of indicia, the markers for positioning on indicia of the game to track progression through the game.

22. The game of claim 21, wherein the indicia on the game playing surface designating first and second paths around the playing surface to track a player's progression through the game, the first track defining a faster progression through the game playing surface, the second track defining a slower progression through the game playing surface.

23. The game of claim 22, wherein the game playing surface comprises a rigid board.

24. The game of claim 23, further comprising a tub of sculpting putty.

25. The game of claim 22, wherein the game playing surface and markers are represented in a multi-media environment.

26. The game kit of claim 25, wherein the multi-media environment comprises a computer based playing environment or an electronic playing environment.

27. A method of game play, comprising:

a) selecting one of a plurality of decks of cards, each deck including a plurality of cards, each card bearing instructions for a player to carry out an activity, wherein each deck contains cards directed to activities associated with one or more related human competencies, wherein the one or more related human competencies is different at least in part from the competency(s) associated with the cards contained in the other deck(s);

b) selecting a card from the selected deck, the deck containing at least a first subset of cards directed to a first activity type and a second subset of cards directed to a second activity type distinct from the first activity type;

c) performing the activity associated with the instructions on the selected card; and d) tracking the progress of the player in the game based on performance of the activity.

28. The method of game play of claim 27, wherein the human competencies is selected from the group consisting of factual knowledge competencies, audio/visual performance competencies, two and/or three-dimensional graphic competencies, and spelling/vocabulary/language competencies.

29. A game kit comprising:

a) a game board marked with a plurality of indicia;

b) a plurality of markers for positioning on indicia of the game board;

c) a first deck of cards including a plurality of cards, each card bearing instructions for a player to carry out an activity, the activity instructions of the cards in the first deck each being associated with a first human core competency selected from the group consisting of factual knowledge competencies, audio/visual performance competencies, two and/or three-dimensional graphic competencies, and spelling/vocabulary competencies, the plurality of cards contained in the first deck comprising at least a first subset of cards directed to a first activity type associated with the first core competency and a second subset of cards directed to a second activity type, distinct from the first activity type, associated with the first core competency and d) a second deck of cards, the second deck including a plurality of cards bearing instructions for a player to carry out an activity, wherein the second deck of cards contains cards directed to activities associated with a second human core competency different at least in part from the first core competency associated with the first deck, performance of the activities on the cards of the first and second decks determining advancement of a player's marker on the game board.

30. The game kit of claim 29, further comprising at least a third subset of cards directed to a third activity type associated with the first core competency and distinct from the first and second activity types.

* * * * *